US005518375A

United States Patent [19]

Vandromme et al.

[11] Patent Number: 5,518,375

[45] Date of Patent: May 21, 1996

[54] DEVICE FOR THE SUCTION AND DELIVERY OF A FLUID, APPARATUS FOR DISPERSING A LIQUID COMPRISING SUCH A DEVICE

[75] Inventors: Michel Vandromme, Le Plessis Brion; Charles Pileur, Noyon, both of France

[73] Assignee: Yves Saint Laurent Parfums, Neuilly sur Seine, France

[21] Appl. No.: 271,665

[22] Filed: Jul. 7, 1994

[30] Foreign Application Priority Data

Jul. 13, 1993 [FR] France ..... 93 08628
Jun. 29, 1994 [EP] European Pat. Off. ..... 94401481

[51] Int. Cl.[6] ..... F04B 17/00

[52] U.S. Cl. ..... 417/413.1; 417/415

[58] Field of Search ..... 417/413.1, 415

[56] References Cited

U.S. PATENT DOCUMENTS

| | | | |
|---|---|---|---|
| 862,867 | 8/1907 | Eggleston . | |
| 1,367,827 | 2/1921 | Noble . | |
| 1,792,920 | 2/1931 | Myers | 417/413.1 X |
| 2,297,025 | 9/1942 | Russell | 417/413.1 X |
| 2,592,297 | 4/1952 | Laguilharre . | |
| 2,796,295 | 6/1957 | McKinnon . | |
| 3,094,076 | 6/1963 | Hyde . | |
| 3,914,958 | 10/1975 | Nelson . | |
| 4,291,588 | 9/1981 | Justice . | |
| 4,951,854 | 8/1990 | Garnier et al. . | |

FOREIGN PATENT DOCUMENTS

| | | |
|---|---|---|
| 1245402 | 9/1960 | France . |
| 2692175 | 12/1993 | France . |
| 2213298 | 9/1973 | Germany . |
| 58-93972 | 6/1983 | Japan . |
| 525736 | 9/1940 | United Kingdom . |
| 705746 | 3/1954 | United Kingdom . |
| 827309 | 2/1960 | United Kingdom . |
| 1224316 | 3/1971 | United Kingdom . |
| 2205361 | 12/1988 | United Kingdom . |
| 2227690 | 8/1990 | United Kingdom . |
| WO92/07091 | 4/1992 | WIPO . |

*Primary Examiner*—Richard E. Gluck
*Attorney, Agent, or Firm*—Pollock, Vande Sande & Priddy

[57] ABSTRACT

The device concerned is for pumping a fluid, and it comprises a piston (206) movable in a metering chamber (208). This piston is driven by a motor through coupling means which include a rotating head (236), provided with a guide path (238) at least locally slanting relative to the axis of the device, as well as a driving part (240) connected with the piston and moving along the guide path.

1 Claim, 4 Drawing Sheets

+9V
-9-

DEVICE FOR THE SUCTION AND DELIVERY OF A FLUID, APPARATUS FOR DISPERSING A LIQUID COMPRISING SUCH A DEVICE

The invention relates primarily To an improved device, of pump or compressor type, for the suction and delivery of a fluid.

Such devices are known and usually include a rod system connected to the motor for driving, by alternating motion, means constituting a piston in a pumping chamber. These rod systems are particularly cumbersome and impose an overall shape (generally a L-shape) of appreciable volume of the device.

One of the problems posed in the case in point is therefore to provide a fluid dispensing device of minimum overall size, so as to be easily integrated in an apparatus supplied with fluid (without having to increase the dimensions of the latter).

As these size demands must not be made to the detriment of performance, the inventors have aimed at reliabity and efficiency. It has also been necessary to take into account the flow rates of fluid with a view to reducing consumption of energy by the device.

In this light, the invention proposes proposes, therefore, a device for the suction or the delivery of a fluid having an axis and including:

an outer body, at least partly hollow, means for forming a piston in this body movable in alternating axial motion to define, with the part of the body adjacent to it, a pumping chamber of variable volume for the suction or the delivery of the fluid, locking means for locking in rotation relative to said body of the means for constituting a piston, and coupling means for the means for forming a piston with a motor, the coupling means comprising:

a head which has on its outer peripheral surface at least a continuous guiding path, closed on itself, and at least locally angularly slanting relative to a plane perpendicular to said axis of the device; said head being associated with the motor so as to be imparted with a rotational movement around this axis, and at least one driving part connected with the means for forming a piston and able to move along said guide path of the head, bringing about the alternating axial motion of the means for constituting a piston.

It will be noted that, advantageously, the coupling means are movable within a relatively small displacement volume, centered on the axis of the device and permitting a substantially coaxial assembly of the principal elements of the dispenser. The latter is thus particularly compact.

The invention also relates to an apparatus for the dispersion or diffusion of a liquid owing to the fluid (gas) supplied by the device integrated into it. A utilization of the apparatus as an environment fragrance diffuser is particularly aimed at.

Within this framework the invention has made it possible to provide:

a reliable and efficient apparatus which rapidly diffuses the liquid, if required in a variable amount, depending on the characteristics of this liquid and on the volume of the place of diffusion;

an inexpensive apparatus, simple to use and permitting, if necessary, the diffusion of different liquids in succession, and doing away with any need to rinse;

a fairly easy modulation of the periodicity of diffusion while atomizing preferably a light "mist" almost invisible to the eye.

To that end, the invention proposes an apparatus comprising:

a supporting body, a recharge cartridge defining a reservoir for the liquid to be dispersed and being adapted to be removably connected with the support body;

diffusion means for said liquid carried by the cartridge and including a gas blowing duct which communicates, on one side, with an outflow passage from the cartridge towards the open air, and means for the supply, on the path of the blown gas, of small amounts of liquid, and a gas dispensing arrangement, disposed in the support body and communicating with the said gas blowing duct, this arrangement being of the type described above.

To promote this liquid dispensing, a further characteristic of the invention provides that the outflow passage of the cartridge which may extend the reservoir on one side will preferably have a convergent/divergent shape, the gas blowing duct and the liquid supply means then stopping advantageously, in the reservoir, at a level where the passage in question will be convergent.

Another characteristic provides, always for this efficiency of diffusion, that the apparatus should have a secondary blown gas (particularly air) duct advancing in the support body of the apparatus to open out around the outflow passage of the cartridge.

The apparatus of the invention having been designed so that the amount of liquid to be dispersed may be easily modulated, mother characteristic provides the integration of a programmable electronic card to control the operation of the gas dispensing device, setting off and interrupting sequentially the supplying with gas of the means of diffusion of the liquid.

Other characteristics and advantages of the invention will further be revealed by the following description, given with reference to the attached drawings supplied solely for the sake of non-limitative examples and wherein.

Figure 4:
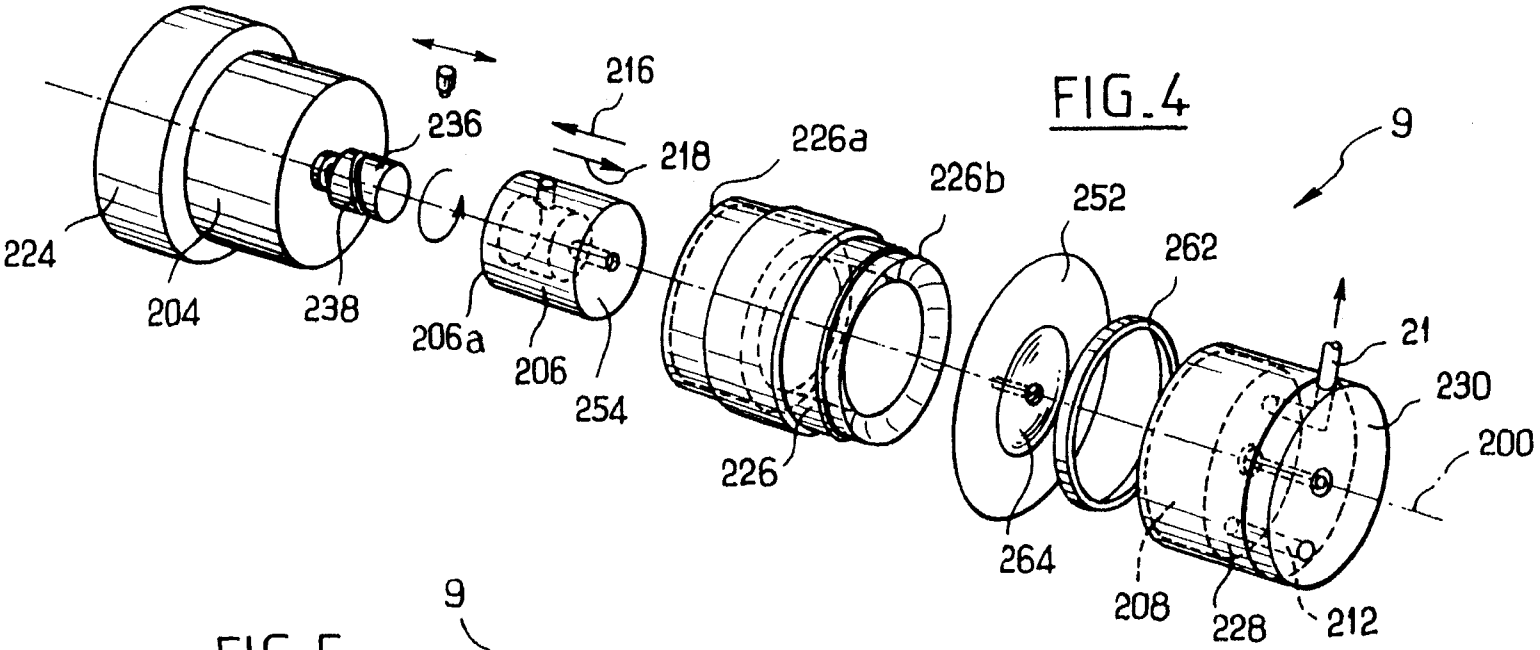
FIG. 4 is an exploded diagrammatic perspective view of the dispensing device of FIG. 1.
Figure 5:
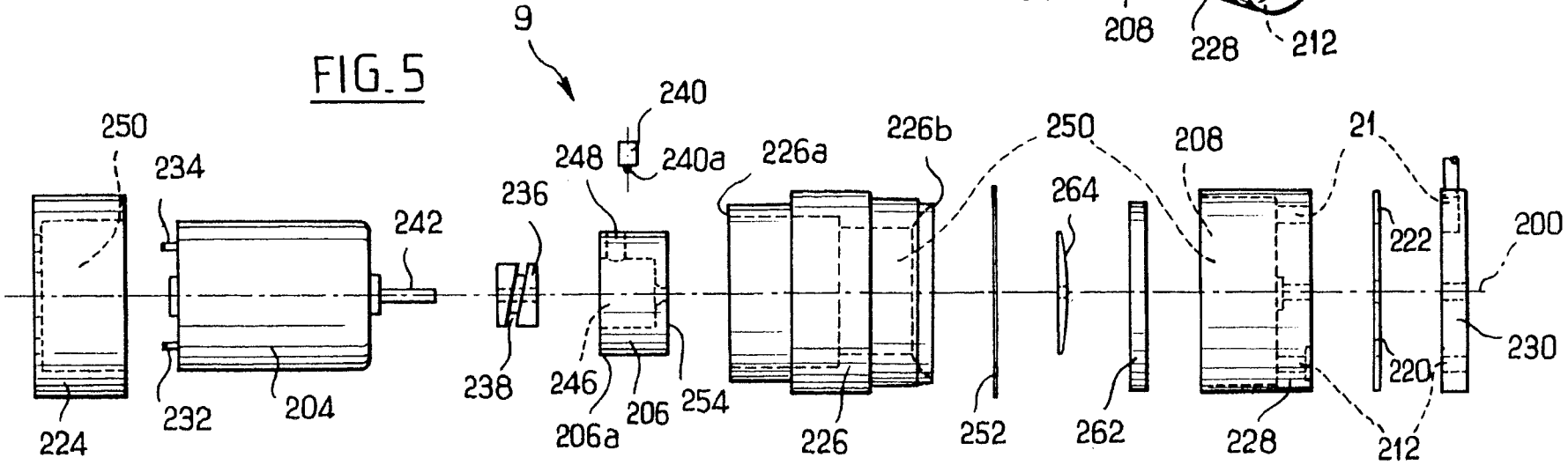
FIG. 5 is another exploded diagrammatic view of the principal elements of the dispenser of FIG. 4.
Figure 6:
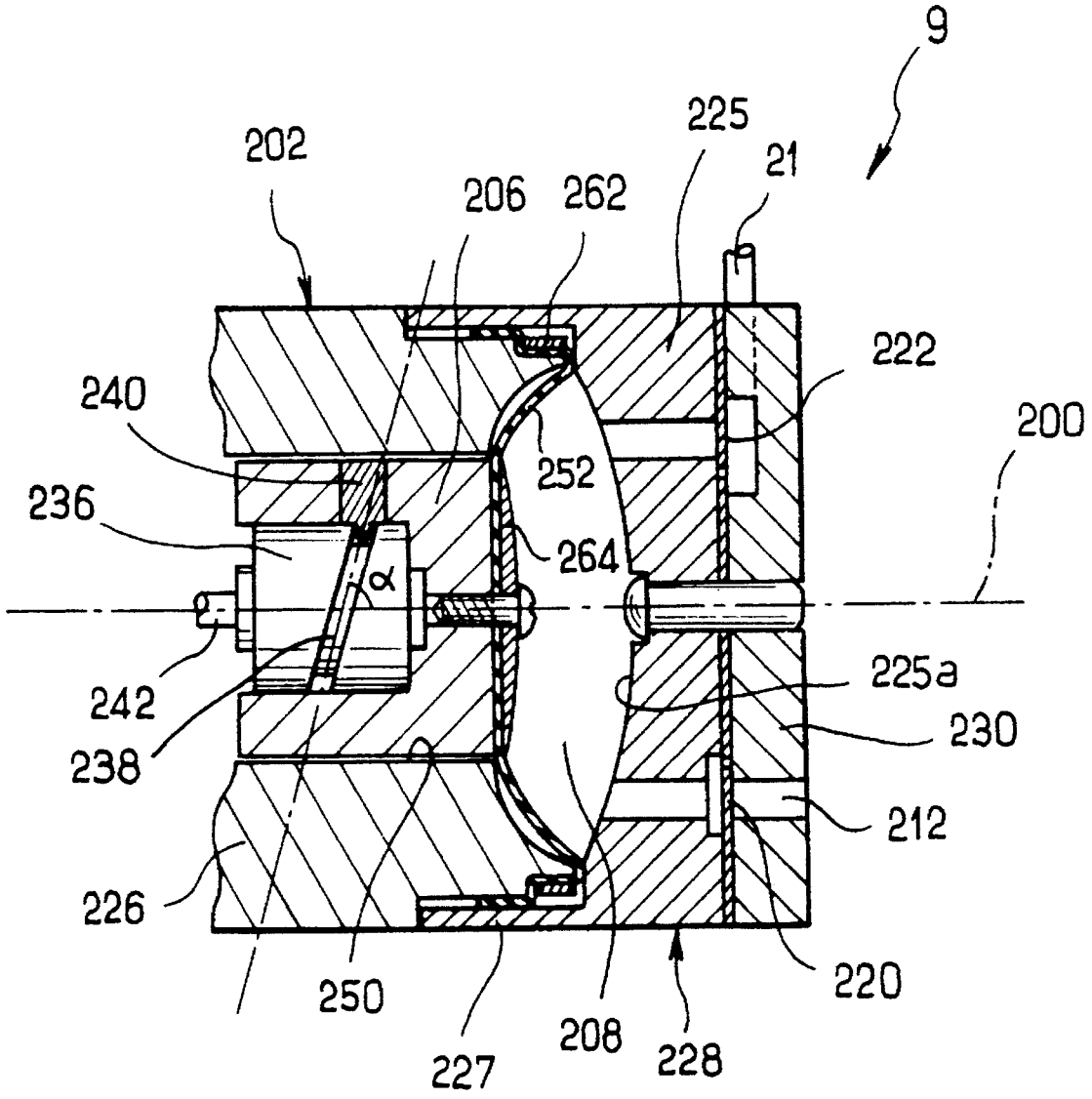
FIG. 6 shows a part magnified view, partly in section, of the dispenser of FIGS. 4 and 5.

According to FIGS. 4 to 6 it will be seen that the fluid dispensing means or device, referenced 9, consists advantageously in a pump or compressor of generally elongated shape (substantially non angular) along an axis 200 for the pumping of various fluids, liquid or gaseous, particularly air. This compressor 9 includes an electric motor 204, means constituting a piston 206, driven by the motor, in axial alternating motion, inside a body 202 (of axis 200) essentially hollow to define, with this body, a pumping chamber 208. This chamber is in communication, through an inlet opening 212, with a source of fluid, namely intake 25, and with a delivery opening or evacuation duct 21. Selective closing means for the passages 212, 21 are also associated with this chamber 208.

The general principle of operation of the pump 9 is such that an axial displacement (without rotation) in the direction of the arrow 216 of the means for constituting a piston brings about an increase of volume of the chamber 208, while the selective closing means holds the fluid inlet passage 212 open and the delivery passage 21 closed. In a reverse translation movement (arrow 218), the means constituting a piston exerts a pressure on the fluid contained in the chamber 208, whereas the closing means uncovers the duct 21 for the delivery of fluid and keep the opening 212 sealed.

In the version illustrated, the body 202 of the device, of rigid plastic here, includes several parts essentially hollow and coaxial 224, 226, 228, cooperating together, defining a cavity 250. In particular, the end part 224 covers the end of the motor, leaving its electric terminals 232, 234 accessible for a supply by a preferably self-contained source stabilized, for example at 6, 9 or 12 volts, such as a battery 27.

The means for forming a piston/motor coupling means comprise in the particular case a metallic head 236 provided with a guide path 238 formed on its external peripheral surface and angularly spaced, at least at various places, from a plane perpendicular to the axis 200, as well as driving means 240 able to move along the path 238.

The head 236, mounted on the drive shaft 242 of the motor, has here the general shape of a cylinder (preferably straight) with circular directrix, and is rotarily moving (in a specific direction) around the axis 200.

The guide path is continuous, closed on itself, and essentially follows a track slanting relative to the axis 200. It consists advantageously in a groove or incision 238 formed on the tubular surface of the head and having here the general shape of a ring, essentially inscribed in a plane which forms with the straight line 200 an acute angle greater than about 70° and smaller than 90°.

As for the drive part 240, this may consist of a metal pin provided with a teat 240*a*, able to be introduced into the groove 238 with a small clearance, while being able to rotate in a part 206 with which it is connected.

It will be noted that advantageously the coupling means balance mechanically by themselves, which is certainly favorable to the efficiency and reliability of the arrangement and to the obtaining of high flows of fluid for a low consumption.

The means constituting piston 206 comprises here the sliding part, of circular cylindrical shape, which is recessed at 246 from one of its ends 206*a*, the open clearance 246 being suitably shaped so that the part 206 can be mounted, relatively tightly, on the head 236 with the possibility of sliding. This sliding part also comprises, made into its wall, an opening 248 for accommodating the pin 240, substantially perpendicular to the axis 200.

Such as illustrated, this piston 206 moves closely, substantially in the tubular element 226 of the body 202. This element 226 which is connected at each of its ends with the elements 224 and 228 has an essentially cylindrical inner wall which widens out towards the end 226*b* for the fitting of the element 226 into the element 228, following a curved surface with concavity facing the cavity 250.

As for the pumping chamber 208, it is here essentially defined by the means for forming a piston, the end part with widened out inner wall of the part 226, and by the element 228. This element 228 has a generally hooded shape with an end transversal part 225 extended by a tubular skirt 227, substantially cylindrical and with generatrix parallel to the axis 200, the part 225 having a curved-in inner face 225*a*, with concavity facing the chamber 208. For the sealing of this chamber 208, on the piston-forming means side, the latter includes a fluid-tight membrane 252 which takes part in the pumping of the fluid. This membrane is held applied at its central part (substantially perpendicularly to the axis 200) against the end transverse face 254 of the piston 206 with which it moves, by a locking disc 264, screwed on.

This flexible and deformable membrane is advantageously, in a natural unstressed state, like a disc, flat or curved, of diameter greater than the section of the piston and, here, also greater than the inner diameter of the parts 226 and 228 to ensure advantageously the sealing of the area of fitting of these parts 226 and 228.

Preferably, this membrane will be chosen to be thin, to a thickness comprised, for example, between a few tenths of a millimeter and a few millimeters (advantageously below 2 mm) to reduce the resistance torque of this membrane and apparently permit obtaining a substantial flow of fluid for a low consumption of the engine. Preferably, the membrane will be made by cutting a disc out of a sheet, or a tube, of plastic material.

To achieve sealing, the membrane is fixed to the piston 206, once the latter has been positioned in the element 226, then it is appropriately stretched on the circular end 226*b* and is held here by a clamping ring 262. The outline of the membrane extends against the external fitting face of the element 226 and then permits a sealed connection with the element 228. Alternatively, the peripheral edge of the membrane could be directly held bound with the body 202 by being clamped and locked between the outer and inner fitting faces of the elements 226 and 228.

It will be observed that this membrane, which is fixed relative to the body at its periphery, constitutes in this particular case the means for locking in rotation relative to the body of the means constituting a piston. Alternatively, there could be provided at least one longitudinal projection and a complementary axial throat, formed on the part 206 and the element 226.

With respect to the fluid flow passages 212 and 21, they are, in this particular case provided in the wall of an end part 230, here substantially solid, of the body 202 and in the wall of the part 225 of the element 228, these parts 228 and 230 being stationarily bonded by all known fixing means, with the interposition between them of the selective closure means of the openings 212 and 21, closely sandwiched. These selective closing means comprise in this particular case two one-way valves constituted by the tongues 220 and 222 (for example of fluid-tight rubber).

When the dispenser 9 is placed in the apparatus 1 described hereinafter (FIG. 1), it would be practical for it to blow air towards a duct 23 of the apparatus; in that event it will be advantageous to connect it to atmosphere by its passage 212 communicating with the outer air intake 25.

Figure 1:
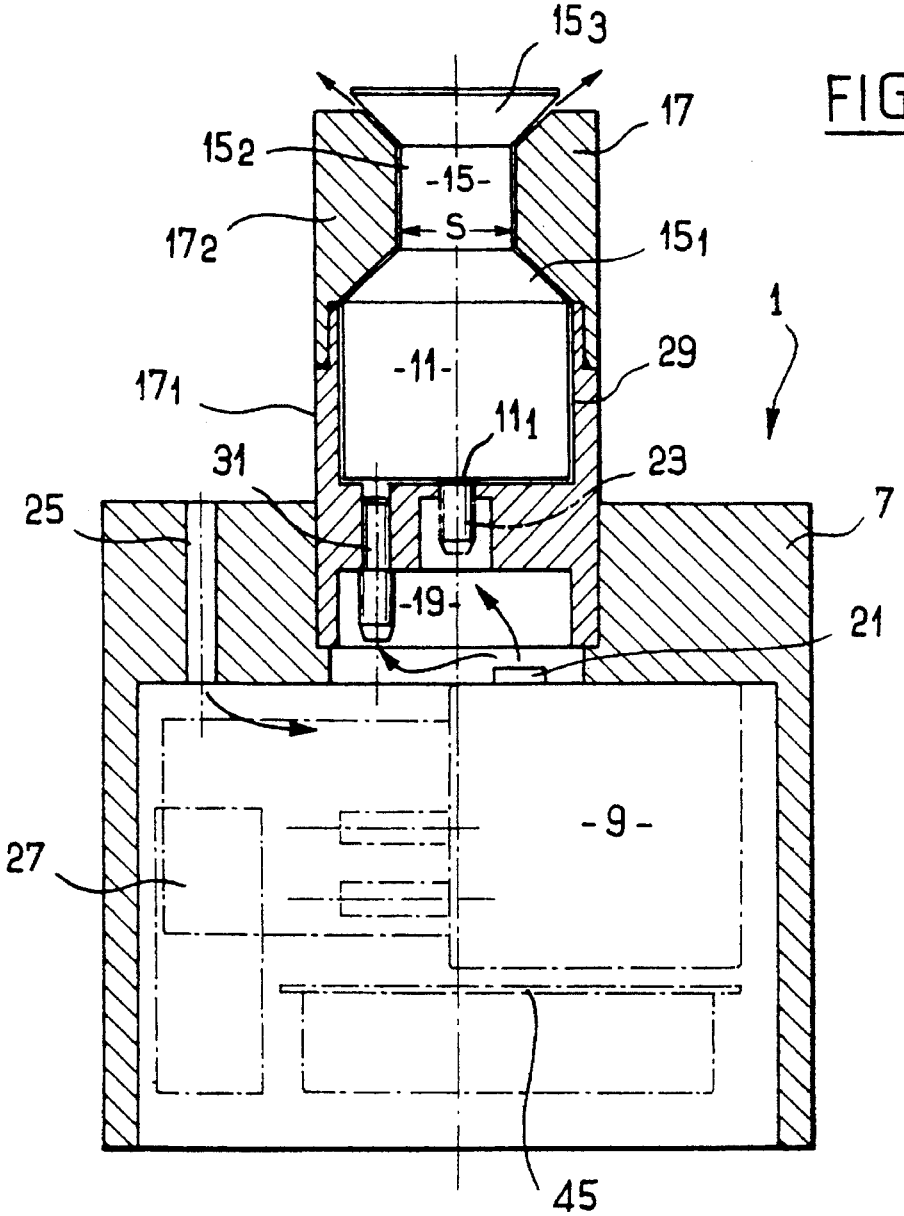
FIG. 1 is a diagrammatic inside view of the apparatus of the invention, with its essential constituent elements which include the fluid dispensing device.

The pump 9 of FIGS. 4 to 6 operates as follows: the sliding part 206 is in a pushed back position towards the motor, the chamber 208 being assumed to be full (maximum fluid volume). As the sliding part is held fixed in rotation, the rotation of the head 236 (driven by the motor) brings about the displacement along its guide path 238 of the device 240 (to which there will be imparted a translation movement towards the axis 200) which then entrains the part 206 in an axial movement in the direction of the arrow 218. The fluid contained in the chamber 208 is then forced inside the passage 21 to open out finally into the inner chamber 19 of the apparatus 1 described hereinafter (FIG. 1). At the end of the travel of the part 206 (minimum volume of the chamber 208) and as the head continues to rotate, the block 206 is brought back by the driving member, along the arrow 216, in the direction of the motor. This creates a depression in the chamber 208 and allows it to be filled.

It will be noted that the means for constituting a piston performs a to and fro movement for each revolution of the head 206. Alternatively, there could be conceived a guide path with a wavy course.

The inventors have observed that it was possible to obtain high flows of fluid, particularly gas, for low pressures, this with low motor consumption. Thus, it has been possible to obtain gas flows of 1.8 liter/min. (on an average between approximately 1.5 and 2 liters/minute) for a pressure of about 200 to 400 millibars, the supply to the motor (rotating for the tests at between 5000 and 6000 rpm) being below 250 milliamps (about 200 milliamps) in 6 volts.

The device 9 may be used for the pumping of liquids and gases and may advantageously be integrated in the diffusion apparatus 1 shown in FIG. 1. Still within the framework of the invention, and so as to obtain high pressures of the fluid (above 1 bar), it will be possible to use a membrane of a thickness in excess of 2 mm (for example up to 4 mm), and in the case of liquids, one could possibly not provide a sealing membrane.

Figure 2:
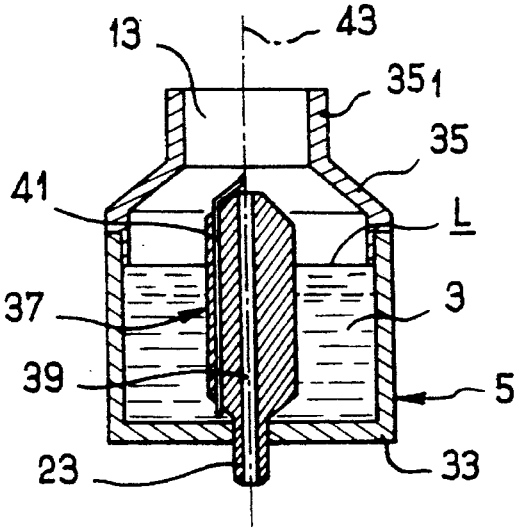
FIG. 2 is an inside view of a cartridge which can be fitted on the apparatus of FIG. 1.

The apparatus 1 is used to disperse a liquid, such as, for example, a toilet lotion 3, contained in a refill cartridge 5 (FIG. 2).

The apparatus 1, or atomizer, includes essentially a support body 7 of plastic material, enclosing, at the bottom, the dispenser 9 (for gas, here, particularly air). At the top, it encloses a dispensing barrel 17, inwardly defining a housing 11 for a removable cartridge 5, so that its exhaust opening 13 (FIG. 2) be, once the cartridge has been placed in its housing, extended by an outflow passage 15. This is defined by the interior conformation of the barrel 17, and an inner chamber 19 ensuring in particular the communication between the outflow 21 of the device 9 and the input duct 23 of the cartridge 5.

It will be noted in FIG. 1 that to improve the diffusion of the liquid under the action of the flow of gas generated by the compressor 9, the outflow passage 15 will advantageously be of convergent/divergent shape, in succession with a convergent $\mathbf{15}_1$, a region of constant section $\mathbf{15}_2$ amd a divergent outlet $\mathbf{15}_3$.

To promote further the atomized dispersion of the liquid, the area 11 for the cartridge 5 and the exhaust passage 15 which extends it, may be surrounded by a duct 29 connected upstream, by means of a calibrated tube 31. The chamber 19 opens with the chamber 19 and opening out downstream, around the divergent $\mathbf{15}_3$ so that there may flow in this passage 29 a gas (air) of secondary nature promoting the dispersion of the main gas (air) flow carrying the liquid to be "atomized".

For setting the cartridge 5 in place, the collar $\mathbf{15}_3$ will be removable and the barrel 17 will include a fixed base $\mathbf{17}_1$ in which the housing will be hollowed out, being, for example, parallelepipedic, open on its top face and having an opening $\mathbf{11}_1$ in its opposite lower face for the passage of the input duct 23, the top part $\mathbf{17}_2$ of the barrel being detachable and able to be made, for example, in two half shells.

As for the refill cartridge 5 of plastic material of FIG. 2, it may consist of a reservoir base 33 containing the liquid 3 and surmounted by an output neck 35 having a convergent part, then an end part of smaller constant neck section $\mathbf{35}_1$ corresponding substantially to the smaller section s of the passage 15.

Preferably, the cartridge 5 contains in addition, the diffusion means 37 which will therefore advantageously permit an atomization of the liquid in a very fine mist, all the more easily as this liquid is volatile. In this particular case, the means 37 includes a single plastic part fixed at the bottom to the base 33 of the cartridge through which it passes to present the above-mentioned input duct 23.

Inside, the part 37 has a gas blowing duct 39 which opens out at the top above the level L of the liquid, as well as a second duct 41, of smaller section than the first, communicating at the bottom with the liquid and opening out, at the top, facing the first duct 39, these ducts 39, 42 being calibrated.

In the illustration, the capillary duct 41 may, for example, have an inner diameter of the order of 0.4 mm, for an upper section of the duct 39 which may be comprised between approximately 0.65 and 1.2 mm.

Advantageously, the duct 39 will stop, in the reservoir, at a level close to the narrowest end of the convergent part of the neck 35, to blow the flow of gas received substantially in the vertical central axis 43 of the cartridge.

To optimize the operation of the apparatus, it has also been envisaged to add, inside the body 7, a programmable electronic card 45 for the control of the gas dispensing means 9.

Figure 3:
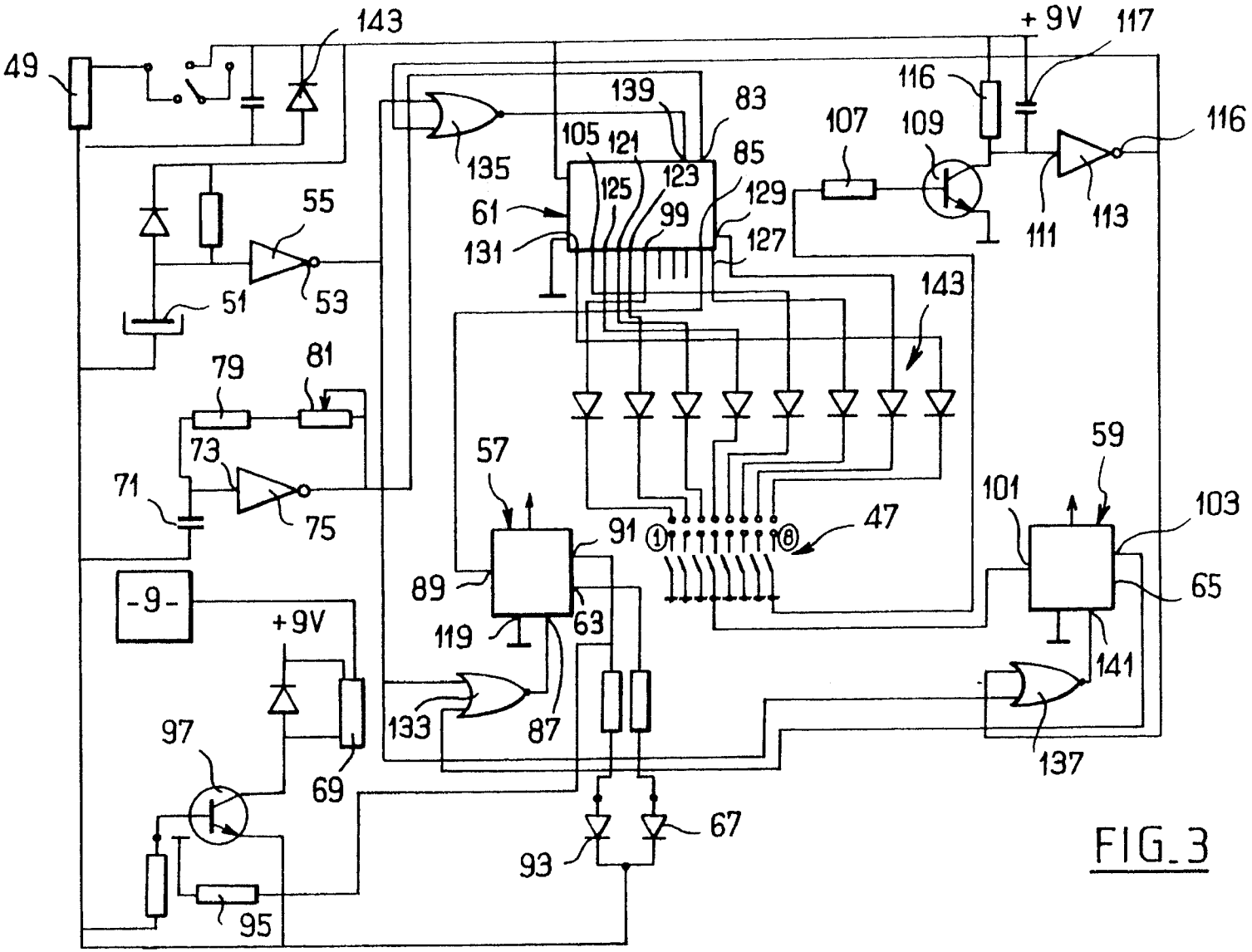
FIG. 3 is a simplified view of the connection diagram of the programmable card which may be provided on the apparatus of FIG. 1.

In FIG. 3 there is represented a possible circuit diagram of this card which may be a programmable card, permitting a control of the operation of the means 9 by setting off and interrupting sequentially the dispensing of gas towards the diffusion means 37. In other words, the card 45 will be substantially constituted on the basis of an electronic time-switch a device for which we shall consider initially the outputs 1 and 5 of the eight switches 47.

When a current is made to flow in the card from the source 49 (9 volts), as lone as the capacitor 51 is not charged, the output 53 of the change-over contact 55 is at the logic level 1. This switching reset is then applied to the two flip-flops 57, 59, as well as to the pulse counter 61 (in this particular case of "4040" type). The counter as well as the two flip-flops 57, 59 are therefore at logic level 0. The terminals 63 and 65 respectively of the counters 57 and 59 are at level 1; the LED (e.g. red) 67 is then on, and the gas dispensing means 9, connected to the connector 69, is inoperative, there being at the time no atomizing of fluid.

Moreover, the capacitor 71 is unloaded. A logic level 0 is therefore applied at the input 73 of the second trigger 75, the output 77 of which is then at level 1. This pin 77 then being at 9 volts, the capacitor 71 is loaded by the resistor 79 in series with a potentiometer 81. When the voltage of the capacitor 71 becomes greater than the toggle voltage of the trigger 75, the latter flips and its output 77 passes to 0 volt. The capacitor 71 discharges into the resistor 79 and the potentiometer 81. When the voltage is adequately low, the trigger 75 flips again, and so on. The trigger 75 is therefore a clock.

Initially, all the outputs of the counter 61 are at mere. At the first clock pulse applied on the input 83 of the counter the latter will start to count: its first output 85 will therefore pass to level 1. The pin 87 of the flip-flop 57 is then at 0, the said flip-flop being therefore ready to memorize. The ascending front coming from the output 85 is then applied to the input 89 of the flip-flop 57. The flip-flop records and its output 91 goes over to 1, whereas its output 63 goes over to 0. The LED 67 goes out, whereas the other LED (for example green) 93 comes on. Thus 9 volts are applied at the input of the resistor 95 and the transistor 97 becomes conductive, the gas dispensing means 9 going then into operation.

The output 1 of the series of switches 47 is assumed to be conductive; at the end of 16 pulses on the clock input of the counter 61, its output 99 passes to 1. An ascending front is applied on the clock input 101 of the flip-flop 59, its output 103 going over to 1, whereas its output 65 is no longer conductive. The dispenser 9 is then no longer supplied, the light passing from green to red (diode 67).

The counter 83 continues to count. The pulses dispatched on the input 89 of the flip-flop 57 are not taken into account as the pin 87 (reset) is still at 1. The fifth switch of the series of switches 47 is closed. At the end of the 256th pulse on the clock input of the counter 61, its output 105 goes over to 1. Therefore 9 volts are dispatched at the input of the resistor 107 and the transistor 109 becomes conductive, so that the input pin 111 of the trigger 113 goes over to 0, the delay time ensured by the resistor 115—capacitor 117 circuit. The output 116 of the trigger therefore goes over to 1. The initialization is then performed of the flip-flop 59 as well as of the counter 61 the output of which 103 thus goes over to 0. Consequently, a logic level 1 or 0 is applied to the pin 87, removing the forced initialization of this flip-flop which can thus restart to count the pulses of the counter 83 coming from its pin 85.

In this way the counter 83 is initialized by the pin 119 of the flip-flop 57, its outputs being at 0. On the first clock pulse, its output 85 goes over to 1, the flip-flop 57 taking into account the ascending front . . . and the cycle recommences.

To regulate the time the pulses last, it will be sufficient to select one of the outputs 99, 121, 123, 125 of the counter 61 with the aid of the switches 47 and, to regulate the time between two pulses. The selection may be made of one of the outputs 105, 127, 129, 131 of this same counter, also with the aid of the switches 47. It will be noted that the presence of logic gates OR 133, 135 and 137, the outputs of which are respectively connected to the pin 87, to the terminal 139 of the counter and to the terminal 141 of the second flip-flop 59, permit the reinitialization (reset) of the flip-flops and of the counter should current be switched. Or at the end of the cycle, the presence of the eight output diodes 143 of the counter permitting, moreover, to prevent short-circuits in the event of two switches being conductive at the same time. As for the diode 143, it permits avoiding the destruction of the integrated circuits should there be a reversal of direction when connecting the battery. The reverse voltage is limited to about 0.7 volt.

We claim:

1. A pump assembly comprising:

a tubular housing;

a cap assembly located at one end of the housing;

a fluid inlet formed in the cap assembly;

a first check valve connected in-line with the inlet for ensuring unidirectional flow therethrough;

a fluid outlet formed in the cap assembly;

a second check valve connected in-line with the outlet for ensuring unidirectional flow therethrough;

a piston located in the housing;

a flexible diaphragm centrally secured to the piston;

a rotary cam assembly located in the housing and connected between a motor driven shaft and the piston for reciprocating the piston coaxially with the shaft, in response to shaft rotation:

the cap assembly having an annular recess for receiving a portion of the housing, a peripheral portion of the diaphragm being intimately engaged between the housing portion and the recess to create a seal around the periphery of the diaphragm and to restrain rotation of the piston.

* * * * *